United States Patent [19]

Oberndorfer et al.

[11] Patent Number: 4,743,877

[45] Date of Patent: May 10, 1988

[54] ELECTROMAGNETIC RELAY

[75] Inventors: Johannes Oberndorfer, Hofsingelding, Fed. Rep. of Germany; Kenji Ono, Osaka, Japan

[73] Assignee: Matsushita Electric Works, Ltd., Osaka, Japan

[21] Appl. No.: 867,949

[22] Filed: May 29, 1986

[30] Foreign Application Priority Data

May 29, 1985 [DE] Fed. Rep. of Germany ..... 3519256
Jun. 10, 1985 [DE] Fed. Rep. of Germany ..... 3520773

[51] Int. Cl.[4] ..... H01H 67/02

[52] U.S. Cl. ..... 335/128; 335/78; 335/80

[58] Field of Search ..... 335/78, 80, 81, 83, 335/84, 106, 120, 121, 122, 123, 124, 125, 128, 130, 133

[56] References Cited

U.S. PATENT DOCUMENTS 3,553,729 1/1971 Mori et al. ..... 335/192
4,323,945 4/1982 Sauer .
4,539,540 9/1985 Kimpel ..... 335/78
4,563,663 1/1986 Niekawa ..... 335/80
4,587,501 5/1986 Agatahama ..... 335/80

*Primary Examiner*—E. A. Goldberg
*Assistant Examiner*—Lincoln Donovan
*Attorney, Agent, or Firm*—Schwartz, Jeffery, Schwaab, Mack, Blumenthal & Evans

[57] ABSTRACT

In an electromagnetic relay including a pivotable armature (11) and contact springs (17) extending substantially in parallel thereto, the actuator (21) for transmitting the armature (11) movement to the contact springs (17) is coupled to the armature (11) with play. Thereby relative displacements between the actuator (21) and the contact spring (17) and the resultant frictional forces are prevented. When the relay is a bistable relay, the coupling between armature (11) and actuator (21) with play furthermore means that in the central position of the armature (11) no spring forces and no frictional forces caused by the actuator (21) are applied thereto but only the magnetic actuating forces will act on the armature (11). Thereby the risk of the armature (11) inadvertently remaining in its neutral central position is practically eliminated.

6 Claims, 4 Drawing Sheets

ELECTROMAGNETIC RELAY

DESCRIPTION

Figure 1:
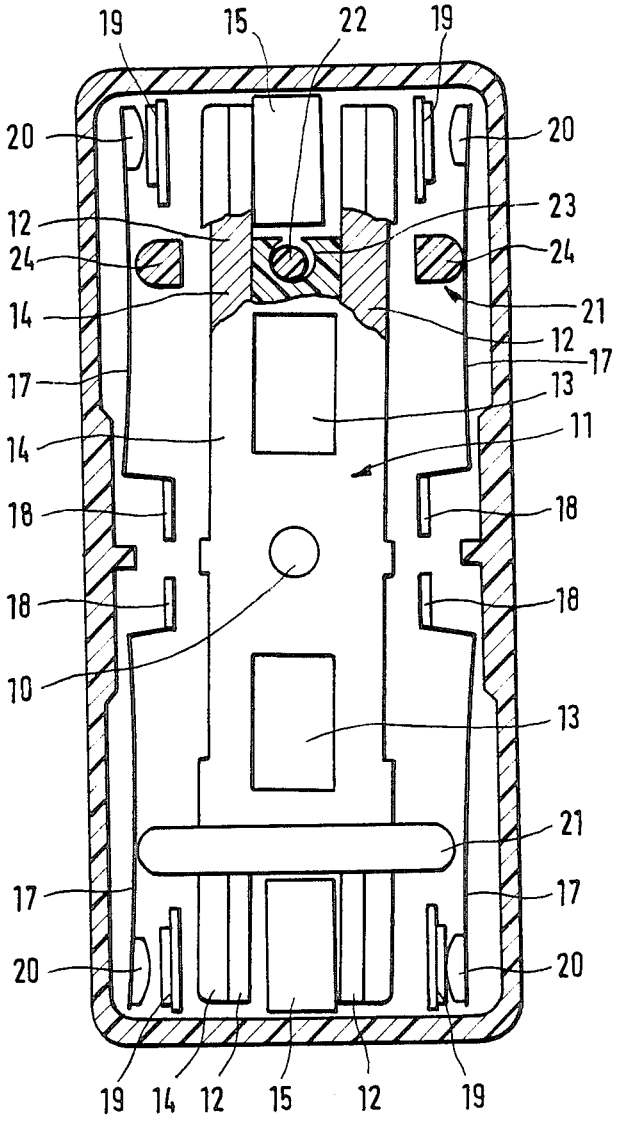

The invention is directed to an electromagnetic relay.

U.S. Pat. No. 4,323,945 discloses an electromagnetic relay which includes an elongate armature adapted to be pivoted between two end positions by the magnetic flux of a relay coil. A pair of movable contact springs each cooperating with an associated fixed contact extend essentially parallel to the armature at both sides thereof. The contact springs are operated by an actuator integrally formed with the armature in such a way that, when the armature is pivoted between its two end positions due to the relay coil being energized, each said contact spring is moved between a closed position engaging a fixed contact and an open position. Each spring is biased in such a way that it resiliently abuts its actuator in one of the two end positions of the armature and during a part of the armature movement subsequent to said end position. The specified publication discloses both so-called lift-off contacts, in which the contact spring is biased to its closed position and is lifted off the fixed contact while abutting the actuator, and so-called flexure contacts in which the contact spring is biased to the open position and upon corresponding movement of the armature is urged by th actuator towards the closed position.

During reversing of the armature from one end position to the other one, relative movement occurs between each contact spring and its associated actuator so that friction is produced in the area where the contact spring abuts the actuator. The relative movement is due to the fact that the pivot point of the armature and thus of the actuator does not coincide with the effective pivot point of the contact spring and the latter pivot point shifts by itself on account of the deflection of the spring. These frictional forces produce a frictional moment which counter-acts the torque exerted on the armature by the magnetic forces and thus causes correspondingly increased magnetic fluxes for obtaining predetermined contact forces.

The afore-mentioned frictional moment has a particularly critical effect with bistable relays in the central area in which the magnetic actuating forces acting on the armature and the contact spring forces also acting thereon respectively cancel each other. Ideally, this neutral area constitutes a point which is overcome by the inertial mass of the armature. However, on account of the frictional moment, which always acts in opposition to the armature movement, there results a finite neutral area incurring the risk that the armature, which is possibly moved to a central position by a mechanical shock or by an electrical pulse corresponding to a partial actuation, remains stuck in such position. In this position the relay is inoperative because the armature cannot be moved by normal actuation into either of its two defined end positions.

As regards the flexure contacts explained above, in which the contact spring is urged to the closed position by the actuator, known relays further exhibit the drawback that chatter movements of the armature when the later reaches its end position which is limited by a stop member are transmitted to the contact spring where they lead to contact chatter.

As a general object, the present invention intends at least in part to eliminate the drawbacks occurring in comparable electromagnetic relays of the prior art. It is a more specific object of the invention to design the electromagnetic relay of the type mentioned above in such a way that the frictional moment which acts against the armature rotation is reduced, and in case of a bistable design the problem of the undesirable central position is practically eliminated, and in case of flexure contacts any contact chatter caused by armature chatter is prevented.

The solution of said object in accordance with the invention is achieved by the features defined in patent claim 1. The play which is basically provided in the coupling between actuator and armature has the effect that the location of the actuator where the contact spring is in resilient abutment may follow the contact spring such that a relative movement between actuator and contact spring and the friction caused thereby is eliminated. Even though friction now occurs at the coupling between actuator and armature, such friction can be substantially reduced by proper design of the bearing location.

Since the mentioned play is particularly provided in the direction of movement of the actuator, with bistable relays there results a region in the central area of movement of the armature in which the actuator is held by the oppositely directed contact spring forces and the armature may overcome the point where the magnetic flux line passes through zero without the actuator and thus without the frictional forces produced by the contact springs and the actuator. Thereby the tendency of the armature to remain in the neutral centre position of the armature is substantially eliminated.

Finally, the play provided in accordance with the invention has the effect that in the case of flexure contacts any chatter movements of the armature at the abutment in the end position are not necessarily also performed by the actuator so that they do not directly result in contact chatter.

Conventionally, efforts have been made to utilize the armature stroke as far as possible for the actuation of the movable contacts; the invention goes just the opposite way, in that a part of the armature movement is not utilized as such so as to achieve the above-described significant advantages.

Advantageous developments of the invention are defined in the dependent claims and are concerned with a particularly low-friction mounting of the actuator relative to the armature, as well as with aspects of easy assembly.

Figure 2:
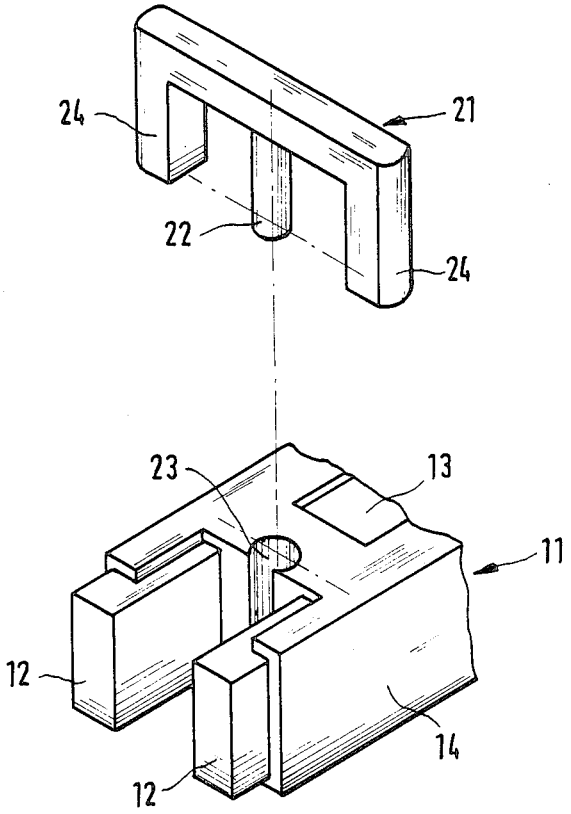
Figure 3:
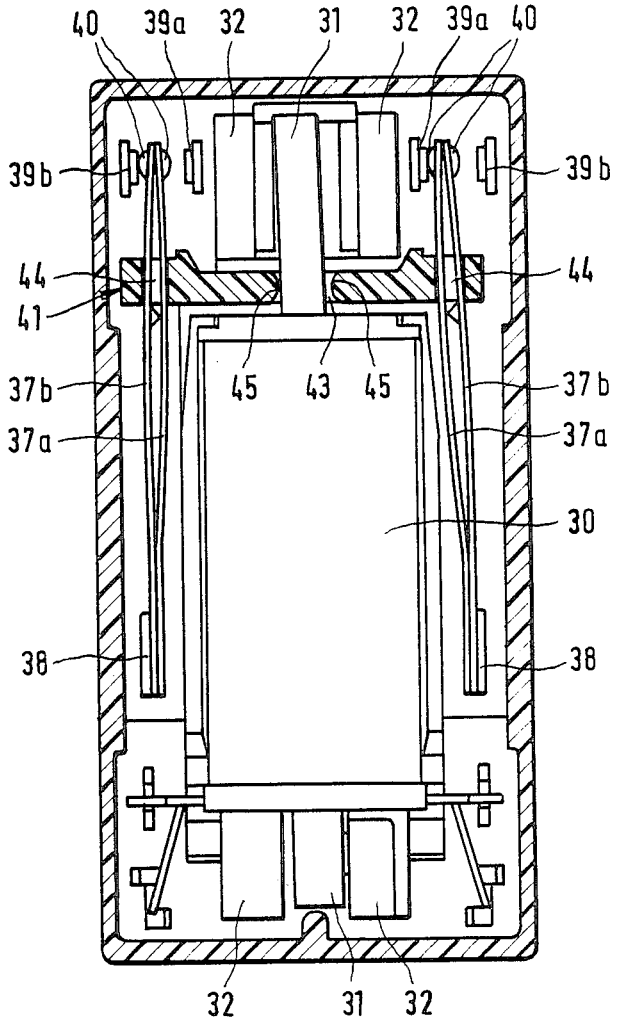
Figure 4:
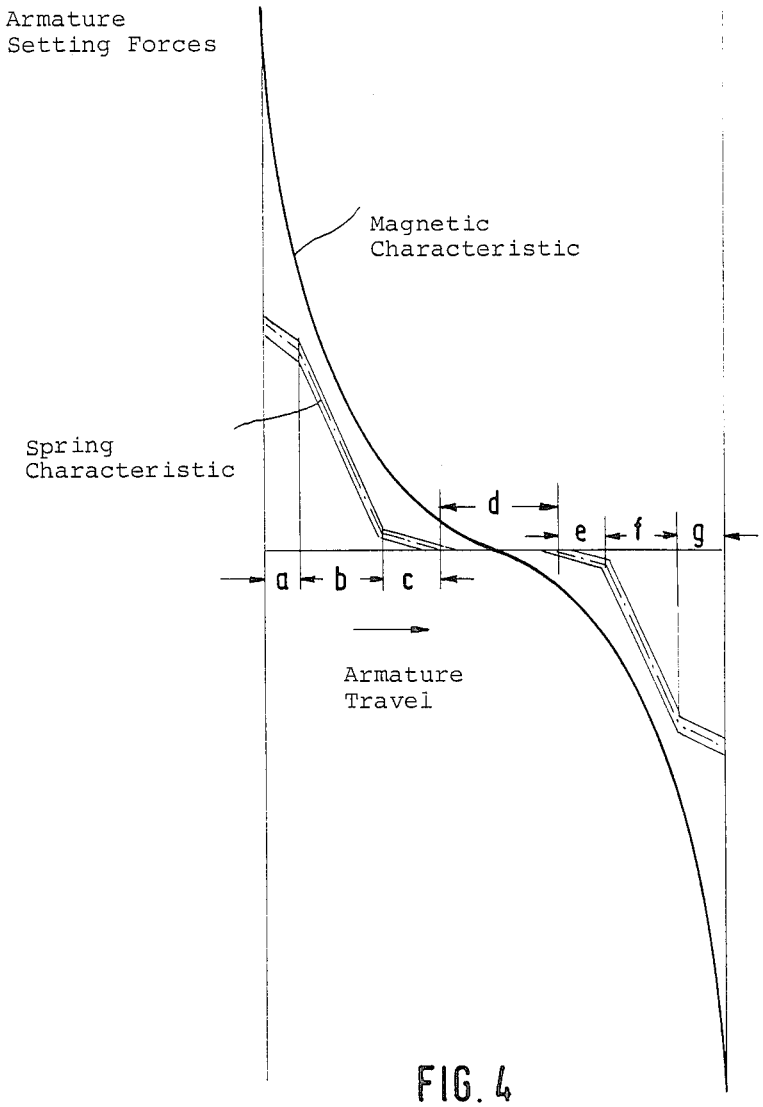

Preferred embodiments of the invention shall be described hereinbelow with reference to the accompanying drawing, in which FIG. 1 is a plan view, partially in section, of an electromagnetic relay with a housing cover in section, FIG. 2 is an exploded view of a portion of the armature and the actuator in the relay shown in FIG. 1, FIG. 3 is a view similar to FIG. 1 showing a relay in accordance with another embodiment of the invention, and FIG. 4 is a force/travel diagram to illustrate the various forces acting on the armature.

The polarized electromagnetic relay with bistable characteristic illustrated in FIG. 1 comprises a substantially H-shaped armature 11 mounted for pivotal movement about a central pin 10, said armature including two pole plates 12 extending in parallel and a permanent magnet 13 interposed therebetween. The pole plates 12 and the permanent magnet 13 are held together by a shell 14 of plastic material. Intermediate the ends of the pole plates 12, which ends face each other in pairs, the upwardly projecting legs 15 of a substantially U-shaped yoke are disposed; a coil (not illustrated in FIG. 1) disposed beneath the armature 11 extends through the central web of said yoke. On either one of the longitudinal sides of the armature 11 two respective contact springs 17 extending substantially in parallel to the armature 11 are provided and are secured with their inner ends to a respective contact terminal 18 and at their outer ends respectively carry a contact member 20 cooperating with a fixed contact 19. The contact springs 17, which are disposed opposite each other at each end of the armature 11, are jointly actuated by an actuator 21.

As will be apparent from FIG. 2, the actuator 21 has substantially E-shaped configuration and engages a central pin 22 having circular cross-section disposed in an opening 23 provided in the plastic sheath 14 and likewise having circular cross-section, the opening 23 having a slightly larger diameter than the pin 22. The axis of the pin 22 and that of the opening 23 extend in parallel to the axis of the pin mounting the armature 11 and thus extend normal to the longitudinal extension of the armature and normal to the direction of movement of the actuator 21. The outer legs 24 of the actuator 21 are respectively curved at their outer faces about axes extending in parallel to the axis of the pin 22. The actuator 21 is an integral member of plastic material.

FIG. 1 shows the armature 11 in its one end position in which the upper left-hand (as viewed in FIG. 1) contact spring 17 (and accordingly the lower right-hand contact spring) is in its closed position and with its inherent biasing force presses against the fixed contact 19 while it is not contacted by the corresponding end of the actuator 21, whereas the upper right-hand contact spring 17 (and accordingly the lower left-hand contact spring) is urged by the facing end of the actuator 21 towards its open position in which it is lifted off the fixed contact 19. When the armature 11 due to energization of the coil is pivoted anti-clockwise to its other end position, the upper actuator 21 in FIG. 1 is initially moved to the left by the biasing force of the upper right-hand contact spring 17 until the left-hand end of the actuator 21 contacts the upper left-hand contact spring 17. This range of movement is indicated by a in the diagram of FIG. 4. Upon further rotation of the armature 11 the biasing force of the upper left-hand contact spring 17 is overcome until the contact spring lifts off its fixed contact 19, and this range of movement is indicated at b in FIG. 4. Now the actuator 21 is moved somewhat further until the forces exerted by the two upper springs 17 are equal. This third range of movement is indicated at c in FIG. 4. Within the ranges of movement a, b and c the pin 22 of the actuator 21 engages the inner wall of the opening 23 in the armature in the position illustrated in FIG. 1. When the armature 11 is further rotated, the actuator 21 remains in its position until the play provided between the pin 22 and the opening 23 is overcome (range d in FIG. 4). Subsequently, the actuator 21 is taken along by the armature 11, wherein at the end of the range of movement e illustrated in FIG. 4 the upper right-hand contact spring 17 is brought into engagement with its fixed contact 19, and at the end of the range of movement f the actuator 21 disengages from the upper right-hand contact spring 17, and at the end of the range of movement g the other end position of the armature 11 has been reached.

As has been explained above, due to the play provided between the pin 22 and the opening 23 the actuator 21 is not taken along in the middle range d of the armature stroke so that the armature 11 is moved alone and no frictional forces caused by spring forces or frictional moments act on the armature. Therefore the magnetic forces illustrated by a full line in FIG. 4 become fully active, which means that the armature actuating force on either side of the zero crossing rises relatively rapidly, and that initially without any reduction by spring or frictional forces. On either side of the central position, therefore, rapidly increasing forces act on the armature and draw it to the respective end position. Thereby the risk of the armature remaining in the centre position is essentially eliminated.

During the reversing motion of the armature the actuator is not pivoted together with the armature 11 about the pin 10 but is displaced substantially in its own longitudinal direction by the respective contact spring or springs 17 engaging the actuator, there being no relative movements between the contact springs 17 and the actuator 21. The sliding friction occurring with conventional relays on these points of contact does not occur with the presently described relay. It is true that there is friction at the bearing location between the pin 22 and the opening 23, but because of the circular configuration this is rather a rolling friction which is in any case less than a sliding friction. Moreover, the leverage at which the frictional force exerts a torque on the armature is only equal to the radius of the pin 22 while it is not equal to the spacing of the contact spring 17 from the centre axis of the armature, as would be the case if the actuator were fixedly connected to the armature. The thus reduced frictional moment means in FIG. 4 that the range intermediate the two fine full lines drawn on either side of the dash-dotted spring characteristic is narrow. This also has the effect that the central range of movement of the armature, in which the magnetic forces act fully on the armature, becomes as wide as possible.

The bistable electromagnetic relay illustrated in FIG. 3 includes a rod-like armature 31 extending through a coil 30, said armature being mounted for rotation about a pivot point at the lower armature end in FIG. 3. The upper end of the armature is reciprocably movable between the upper ends of two pole plates 32 which have a permanent magnet (not visible in FIG. 3) disposed therebetween. On either side of the coil and the armature 31 a pair of contact springs **37*a*, 37*b* is provided, the lower ends of said springs being respectively secured to a contact terminal 38. The upper free ends of the contact springs 37*a*, 37*b* have contact members 40 provided thereon which respectively cooperate with fixed contacts 39*a*, 39*b*. The movement of the armature 31 is transmitted to the contact springs 37*a*, 37*b* via an actuator 41, the contact springs 37*a*, 37*b* being inserted in recesses 44 in the actuator 41. The contact springs 37*a*, 37*b* of each pair are biased against one another in such a way that they resiliently engage the peripheral walls of the respective recess 44. During the first part of the contact closing movement each contact spring 37*a*, 37*b* together with the associated fixed contact 39*a*, 39*b* constitutes a lift-off contact as in the relay shown in FIG. 1**, while in the second and last part of the contact closing movement it constitutes a flexure contact, the contact pressure being increased by the actuator via the respective other contact spring.

The actuator 41 is provided with a central opening 43 which in the direction of movement of the actuator 41 is greater than the width of the armature 31. Similar to the embodiment shown in FIG. 1, this will result in a play in the coupling between armature 31 and actuator 41, said play having the effects already described above.

The peripheral surfaces 45 of the opening 43 facing the armature 31 are respectively curved about an axis which is normal to the longitudinal extension of the armature 31 and to the direction of movement of the actuator 41. Therefore the actuator 41 can not only be displaced with play relative to the armature 31 in actuating direction but can also be pivoted about the armature 31. This ability to pivot means that the actuator 41 is movable in its longitudinal direction in spite of the rotary movement of the armature 31 and that therefore relative displacements between the actuator 41 and the contact springs 37*a*, 37*b* are prevented. In this case frictional forces likewise occur only at the point of contact between the actuator 41 and the armature 31 which result from the rolling motion occurring at said location and which, moreover, produce a frictional moment only with a leverage corresponding to half the width of the armature 31.

In respect of the flexure contacts 37*b*, 39*b* there results the above-described advantage in the embodiment of FIG. 3 that even when the armature 31 upon movement reaches, say, the left-hand end position shown in FIG. 3 and abuts the upper end of the pole plate 32, the resulting chatter movements are not necessarily transmitted to the left-hand contact springs 37*a*, 37*b* because of the play provided between armature 31 and actuator 41, so that no contact chatter is caused between the left-hand contact spring 37*b* and the associated fixed contact 39*b*, which would be the case with a rigid connection between armature 31 and actuator 41 or when the actuator were formed integrally with the armature as in the prior art.

We claim:

1. A bistable electromagnetic relay comprising:

a coil producing a magnetic flux, an elongate armature piviotally mounted and movable by the magnetic flux between two end positions, a fixed contact, a movable contact spring extending substantially parallel to said armature, and a separate actuator movable relative to said armature with a play which is effective particularly in the direction of movement of said armature to prevent the armature from becoming stuck in a neutral middle position, said contact spring resiliently abutting said actuator in one of said end positions and during part of the movement of said armature.

2. The relay of claim 1, wherein said actuator includes a pin extending transversely of the direction of movement of said armature and engaging an opening provided in said armature, said armature being larger than said pin in said direction of movement.

3. The relay of claim 2, wherein said pin has a circular cross-section, and said opening has a larger diameter with respect to said direction of movement.

4. The relay of claim 1, wherein said armature has a portion passing through an opening provided in said actuator, said opening being greater than said armature portion in the direction of movement of said armature.

5. The relay of claim 4, wherein surfaces defining said opening in said direction of movement are curved about an axis which is perpendicular to said direction of movement and to the direction in which said elongate armature extends.

6. The relay of claim 1, wherein said actuator is adapted to be inserted into said armature along a direction which extends transversely to the direction of movement of said armature and to the direction in which said elongate armature extends.

* * * * *